US006941751B2

(12) United States Patent
Yamamoto et al.

(10) Patent No.: US 6,941,751 B2
(45) Date of Patent: Sep. 13, 2005

(54) EXHAUST MUFFLER AND MUFFLER SYSTEM FOR USE WITH AN INTERNAL COMBUSTION ENGINE

(75) Inventors: Kazuo Yamamoto, Saitama (JP); Kihoko Kaita, Saitama (JP); Kazuhiro Yasuda, Saitama (JP); Kiyoshi Kidashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 87 days.

(21) Appl. No.: 10/725,961

(22) Filed: Dec. 2, 2003

(65) Prior Publication Data

US 2004/0206073 A1 Oct. 21, 2004

(30) Foreign Application Priority Data

Dec. 6, 2002 (JP) ..... 2002-354612

(51) Int. Cl.[7] ..... F01N 7/00

(52) U.S. Cl. ..... 60/322; 60/305; 60/312; 60/313; 60/314; 60/323; 181/277; 181/231; 181/241; 181/255

(58) Field of Search ..... 60/305, 311, 312, 60/313, 314, 322, 323, 324; 181/227, 228, 231, 255, 258, 241

(56) References Cited

U.S. PATENT DOCUMENTS 3,677,364 A * 7/1972 Pawlina ..... 181/269
3,786,896 A * 1/1974 Foster et al. ..... 181/265
5,451,728 A * 9/1995 Chandler et al. ..... 181/230
5,627,351 A * 5/1997 Okuma et al. ..... 181/231
5,857,327 A * 1/1999 Sato et al. ..... 60/302
5,969,299 A * 10/1999 Yamaguchi et al. ..... 181/227
6,394,225 B1 * 5/2002 Yasuda ..... 181/256

FOREIGN PATENT DOCUMENTS

JP 10266828 10/1998

* cited by examiner

*Primary Examiner*—Binh Q. Tran
(74) *Attorney, Agent, or Firm*—Carrier, Blackman & Associates, P.C.; William D. Blackman; Joseph P. Carrier

(57) ABSTRACT

An exhaust muffler system for use on a motorcycle or four-wheeled vehicle provides for operation in either of two modes, a regular configuration that provides a high degree of noise reduction, or a racing specification that provides for a freer-flowing exhaust. Without changing the main body of the muffler, an operator can choose between a quieter, public road setting or a louder, high performance setting. The muffler is provided with two interchangeable spark arresters, and a main body having multiple expansion chambers therein, defined by bulkheads. When a regular spark arrester is installed, exhaust gas passes through one bulkhead three times, greatly reducing the noise produced. With the spark arrester removed, the exhaust gas passes straight through to the open air, enhancing performance. A seal is provided between the bulkheads and the spark arrester, which provides for extension or retraction in the lengthwise direction of the tail pipe.

11 Claims, 13 Drawing Sheets

EXHAUST MUFFLER AND MUFFLER SYSTEM FOR USE WITH AN INTERNAL COMBUSTION ENGINE

CROSS-REFERENCE TO RELATED APPLICATIONS

The present application claims priority under 35 USC 119 based on Japanese patent application No. 2002-354612, filed Dec. 6, 2002.

BACKGROUND OF THE INVENTION

1. Field of the Invention

The present invention relates to an exhaust muffler and to a muffler system for connecting to an exhaust pipe of an internal combustion engine, used on a motorcycle or four-wheeled vehicle. More particularly, the present invention relates to an exhaust muffler and related muffler system, for connecting to an exhaust pipe of an internal combustion engine used on a motorcycle or four-wheeled vehicle, in which an exhaust muffler is convertible between a first configuration, for use on public roads where low noise is required, and a second configuration for use in racing competition, where enhanced performance is required.

2. Description of the Background Art

Vehicular exhaust mufflers have been known that define a plurality of expansion chambers using a plurality of bulkheads, and that are provided with a removable spark arrester equipped with a tail pipe at a rear part thereof.

A spark arrester is a device for catching and trapping sparks and soot included in exhaust gas of an internal combustion engine, and for preventing the sparks and soot from being released to the atmosphere. When the spark arrester is detachable, exhaust back pressure in the expansion chambers is usually set to be highest at the expansion chamber closest to the front near the exhaust pipe, and becomes sequentially lower as it moves rearwardly within the exhaust muffler. The object of providing a detachable spark arrester is to enable maintenance of the muffler and the spark arrester, and to enable changing of the spark arrester in order to economically provide exhaust devices for differing performance requirements.

An exhaust muffler including a removable and replaceable spark arrester is described in Japanese Patent Laid-open Publication No. Hei. 10-266828 (refer, for example, to effects of the invention, FIG. 2, and FIG. 5 of the reference).

Although the known devices have some utility for their intended purposes, a need still exists in the art for an improved exhaust muffler for an internal combustion engine. In particular, there is a need for an improved exhaust muffler for an internal combustion engine.

SUMMARY OF THE INVENTION

The present invention therefore provides an improved exhaust muffler with a detachable spark arrester, equipped with a tail pipe at a rear part thereof. An exhaust muffler according to a first illustrative embodiment hereof is equipped with a plurality of expansion chambers defined by a plurality of bulkheads. In the exhaust muffler according to the first embodiment hereof, the muffler can be adapted for use on public roads or for use in racing by changing the spark arrester without changing the main body. By using the muffler according to the present invention, either quietness of the exhaust muffler or output performance of the internal combustion engine can be maximized, depending on which spark arrester is used.

In a first aspect of the present invention, an exhaust muffler, provided for use with an internal combustion engine, is provided with a plurality of expansion chambers defined by a plurality of bulkheads within a main body of the exhaust muffler. The muffler is adapted to be connected to an exhaust pipe of an internal combustion engine, and includes a removable spark arrester equipped with a tail pipe provided in a detachable manner at a rear part of the main body.

The muffler according to the first embodiment is structured, constructed and arranged such that when a regular, non-racing spark arrester is installed, exhaust flow is made to pass through at least one bulkhead three times. This occurs because the tailpipe of the regular spark arrester is configured to connect the expansion chambers, and a plurality of communicating pipes are fixed so as to also connect the expansion chambers.

When the regular spark arrester is removed, exhaust flow passes through the communicating pipes, and may bypass one of the expansion chambers so as to be released to the outside.

As a result of the present invention having the above configuration, when the regular non-racing spark arrester is installed, a so-called "three-pass" structure is adopted, where exhaust gas passes through a bulkhead three times. Silencing of the exhaust muffler is therefore improved when traveling on public roads, and when the regular spark arrester is removed, this can be used as a racing exhaust muffler for which high-output is demanded. It is therefore possible to divide use of this exhaust muffler between traveling on public roads and racing use, without changing the main portion of the exhaust muffler.

In a second aspect of the present invention, an exhaust muffler for an internal combustion engine is provided with a plurality of expansion chambers, defined by a plurality of bulk heads within a main body of the exhaust muffler. The muffler is adapted to be connected to an exhaust pipe of an internal combustion engine, and includes a removable spark arrester equipped with a tail pipe provided in a detachable manner at a rear part of the main body.

The muffler is configured such that when the regular non-racing spark arrester is installed, exhaust flow is made to pass through at least one bulkhead three times by the tail pipe installed so as to connect the expansion chambers and plurality of communicating pipes fixed so as to connect the expansion chambers. When the regular spark arrester is removed, exhaust flow passes straight through a through-hole opening at the bulkheads, so as to be released to the open air.

In this second aspect of the invention also, when the spark arrester is installed, a so-called "three-pass" structure is adopted where exhaust gas passes through a bulkhead three times. Silencing of the exhaust muffler is therefore improved when traveling on public roads, and when the regular spark arrester is removed, this can be used as a racing exhaust muffler for which high output is demanded, without changing portions of the body of the exhaust muffler.

In a third aspect of the present invention, a seal is provided between the bulkheads and the spark arrester when the spark arrester is installed, and the seal is provided via a sliding part or elastic part, permitting extension and retraction in the lengthwise direction of the tail pipe while still maintaining a seal.

As the present invention is configured in this manner, gas and sound do not leak into neighboring expansion chambers and silencing is improved. Further, the tail pipe has a slide structure that permits extension and retraction. Thermal expansion is therefore relieved, there is little fatigue even with repeated expansion and retraction, and durability is improved. Further, it is therefore possible to provide a minimum pressure expansion chamber next to a maximum pressure expansion chamber, a three-pass structure can be realized, and silencing on public roads can be improved.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 3(*b*) is a rear plan view of the regular spark arrester 18.

FIG. 5(*b*) is a rear plan view of the racing spark arrester 31.

FIG. 11(*b*) is a rear plan view of the regular spark arrester 53 of FIG. 11(*a*).

DETAILED DESCRIPTION OF THE INVENTION

Herein, only structures considered necessary for clarifying the present invention are described. Other conventional structures, and those of ancillary and auxiliary components of the system, are assumed to be known and understood by those skilled in the art.

Figure 13:
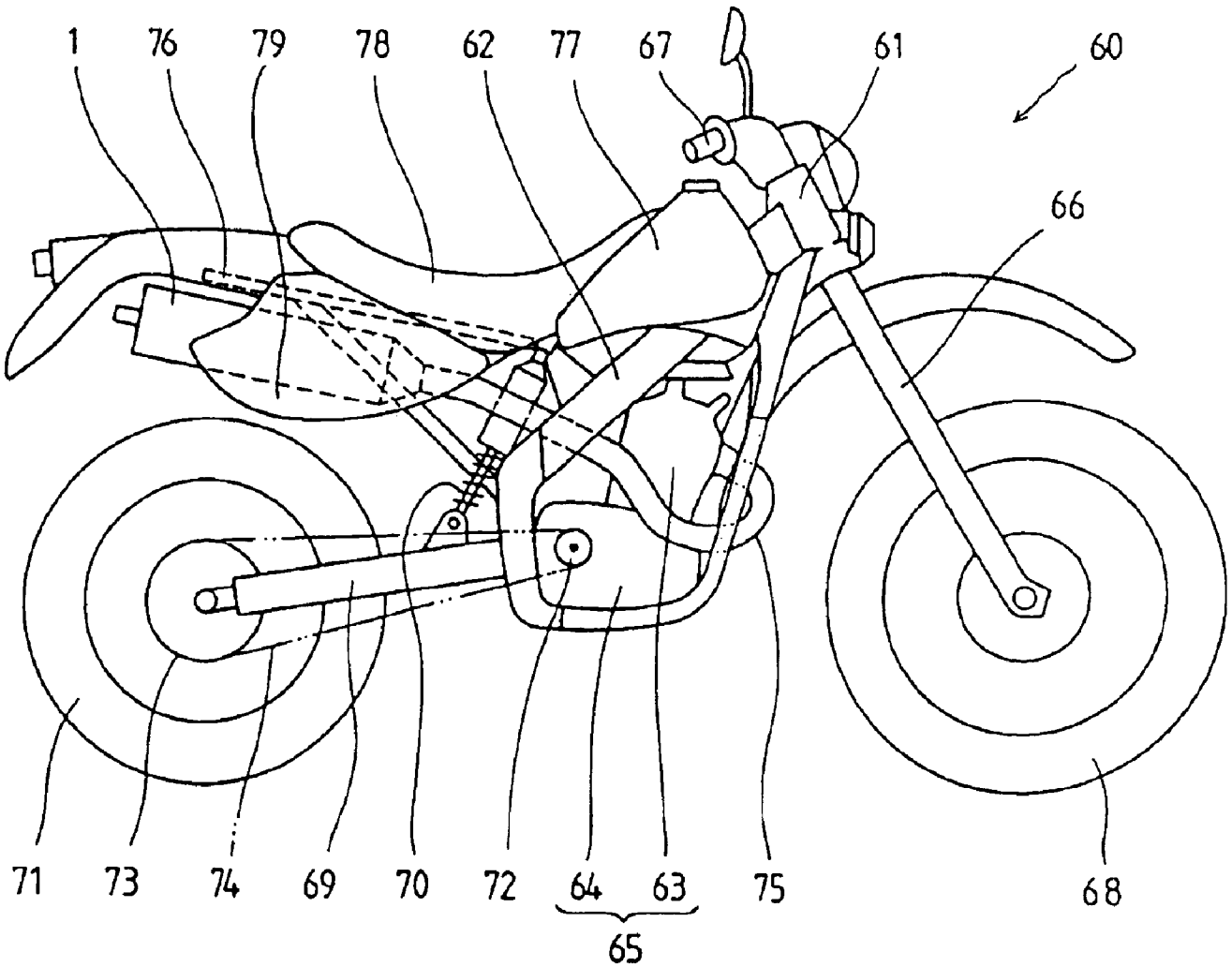
FIG. 13 is a side view of a motorcycle equipped with an exhaust muffler system according to the present invention.

FIG. 13 is a side view of a motorcycle 60 equipped with an exhaust muffler 1 according to a first embodiment of the present invention. A powertrain 65, integrating an internal combustion engine 63 and a transmission 64, is suspended at the center of a vehicle frame 62 spanning to the head pipe 61 of the motorcycle. The vehicle frame 62 is configured by connecting a plurality of members.

The front fork 66 is rotatably supported at the head pipe 61, a handlebar 67 is mounted at an upper end of the head pipe 61, and a front wheel 68 is attached to the front fork in conventional fashion.

A rear fork is pivotally attached to a rear part of the vehicle frame 62 at a pivot 72, so as to be capable of swinging up and down. A rear shock absorber 70 is installed between the rear fork 69 and the vehicle frame 62. A rear wheel 71 is axially supported at a rear end of the rear fork 69. The rear wheel 71 is driven by a chain 74 wrapped around a driven sprocket 72 installed at the end of an output shaft of the power unit 65 and a driven sprocket 73 fitted to a shaft of the rear wheel 71. The output shaft is parallel with the crankshaft, etc, in a direction from left to right of the vehicle body.

An exhaust pipe 75, spanning to an exhaust port provided at the front side of the internal combustion engine 63, goes around the right side of the vehicle body so as to reach the rear part of the vehicle body. The rear end of the exhaust pipe 75 is connected to the front end of the exhaust muffler 1. The front end of the exhaust muffler 1 is supportively connected to the vehicle frame 62, and is suspended from a seat rail 76 extending to the rear.

A fuel tank 77 is installed at an upper part of the vehicle frame 62, and a seat 78 is provided at an upper part of the vehicle frame 62. The seat 78 is situated at an upper part of the seat rail 76. Numeral 79 denotes a side cover.

An exhaust muffler of a second embodiment (to be described later) is installed at a position that is the same as the depicted position of the exhaust muffler 1.

Figure 14:
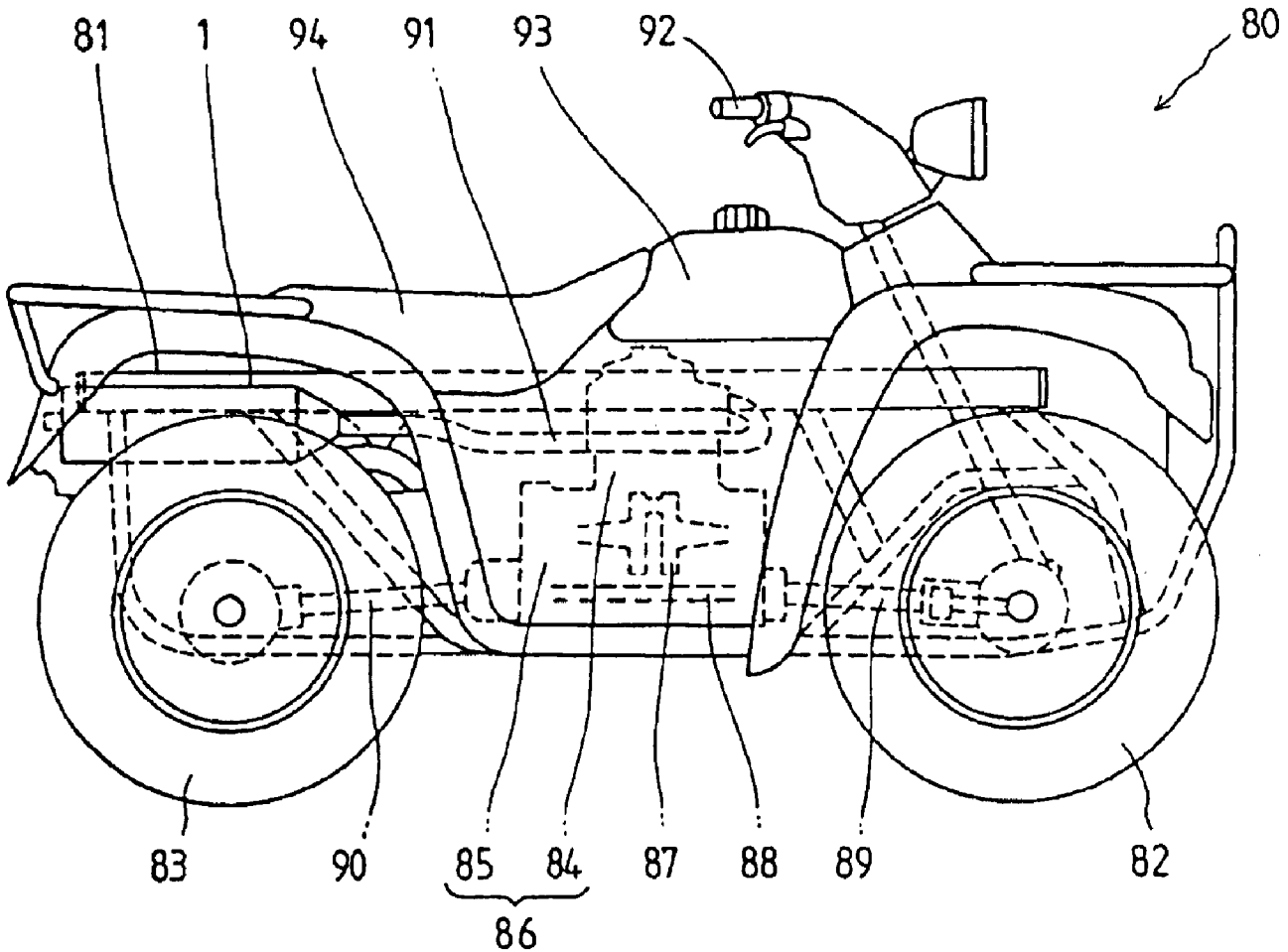
FIG. 14 is a side view of a four-wheeled vehicle equipped with an exhaust muffler system according to the present invention.

FIG. 14 is a side view of a four-wheeled all-terrain vehicle (off-road saddled vehicle) 80 equipped with an exhaust muffler 1 according to a first embodiment of the present invention. This vehicle 80 is provided with a pair of left and right front wheels 82 and a pair of left and right rear wheels 83 to the front and rear of the vehicle frame 81. A powertrain 86, integrating an internal combustion engine 84 and a transmission 85, is supported in the center of the vehicle frame 81. The powertrain 86 has a structure where the crankshaft 87 runs in the longitudinal direction of the vehicle. Rotation of the crankshaft 87 is transmitted to an output shaft 88 via each shaft of the transmission 85. Each of these shafts is parallel with the crankshaft 87 and is arranged in a direction running from the front to the rear of the vehicle body.

The front wheel 82 is driven by a front drive shaft 89, coupled to a front end of the output shaft 88, and the rear wheel 83 is driven by a rear wheel drive shaft 90, coupled to a rear end of the output shaft 88.

An exhaust pipe 91, spanning to an exhaust port provided at the front side of the internal combustion engine 84, goes around the side of the internal combustion engine 84 so as to reach the rear part of the vehicle body. The rear end of the exhaust pipe 91 is connected to the front end of the exhaust muffler 1. The exhaust muffler 1 is suspended, at a vehicle frame 81, between the vehicle frame 81 and the rear wheel 83.

A handlebar 92, a fuel tank 93, and a seat 94 are also installed on an upper part of the vehicle, in order from the front towards the back.

An exhaust muffler according to a second embodiment hereof (to be described later) is installed at a position that is the same as the exhaust muffler 1.

Overview of the Exhaust Muffler System

The exhaust muffler system 1 according to the first embodiment of the present invention will now described, with reference to the drawing figures.

The exhaust muffler system of the first embodiment includes a set of three component members, including an exhaust muffler main body 2, and two interchangeable spark arresters 18, 32 that can be selectively attached to and detached from the main body 2. The three components of the system can be seen together in FIG. 15. The muffler system includes both a regular, non-racing spark arrester 18 for use in public road travel, and a racing spark arrester 31. The two types of spark arrester can be interchanged on the exhaust muffler body 2, according to the contemplated use of the vehicle.

A state in which the regular spark arrester 18 is installed at the exhaust muffler body 2 is referred to herein as a regular configuration 1A of the first embodiment. A state in which the racing spark arrester 31 is installed at the exhaust muffler body 2 is referred to herein as a racing configuration 1B of the first embodiment.

Main Body Portion

Figure 1:
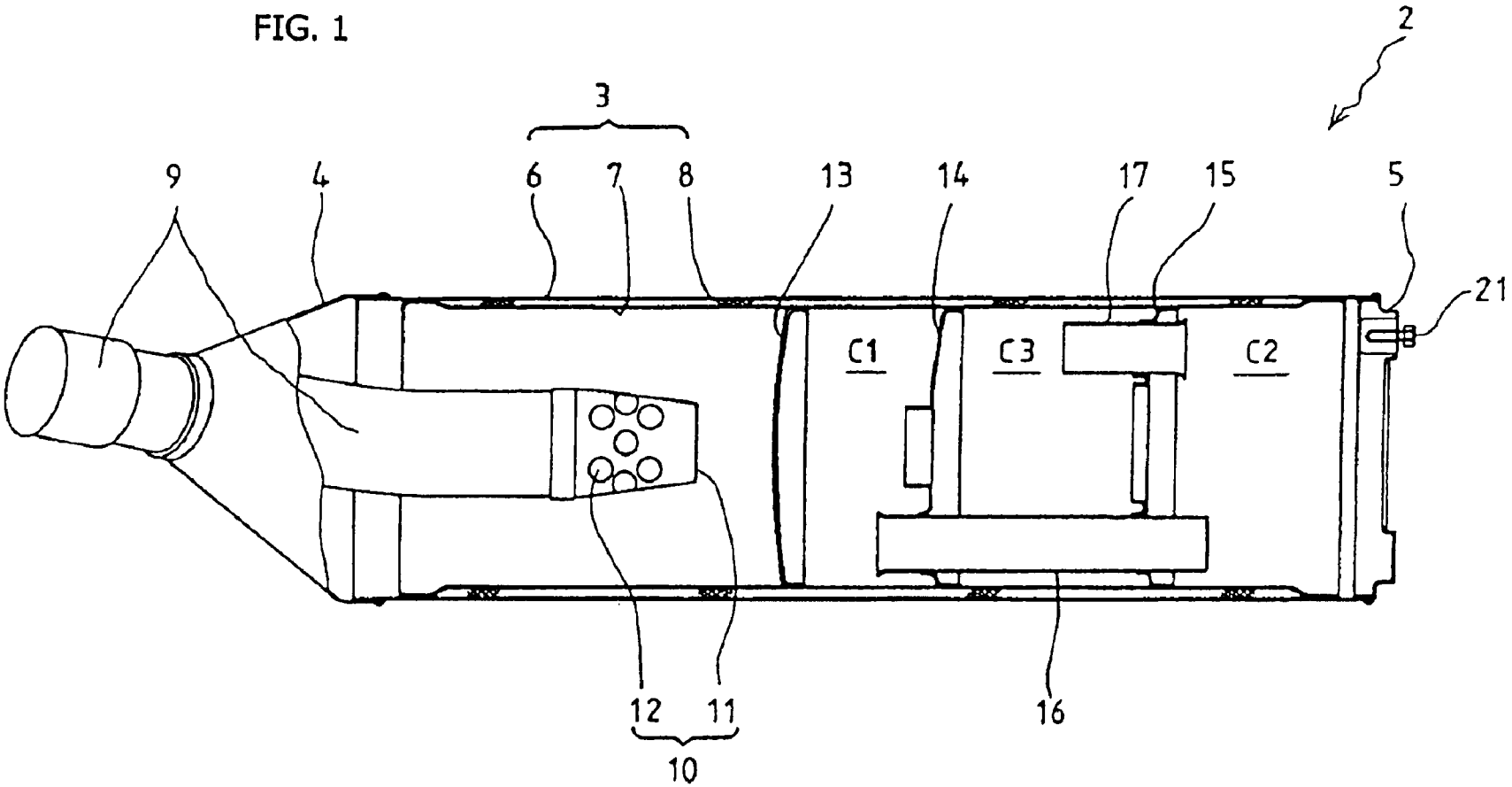
FIG. 1 is a longitudinal cross-sectional view of a main body 2 of an exhaust muffler system, according to a first embodiment of the present invention.

FIG. 1 is a longitudinal cross-section of a main body portion 2 of the exhaust muffler system, according to the first embodiment hereof. In FIG. 1, the outer shell of the main body 2 of the exhaust muffler system includes a cylindrical central body part 3, a conical front cover 4, and a rear plate 5 having a large opening at a central part thereof. The central body part 3 also includes an outer body plate 6, an inner body plate 7 disposed inside the outer body plate, and heat-tolerant noise-absorbing material 8, such as glass wool, etc., filling in between the respective inner and outer body plates 6, 7.

An introduction pipe 9, connected to the exhaust pipe of the internal combustion engine, passes through the top part of the front cover 4, and extends into the central body part 3, as shown. An exhaust gas nozzle 10, at the end of the introduction pipe 9, opens out within the main body 2. The exhaust gas nozzle 10 defines an end opening 111 of the introduction pipe 9, and has a multiplicity of small holes 12 made in the side surface of the top part thereof, to create a gush of gas spread out about the interior of the main body 2.

In order from the front, a perforated metal partition plate 13, a first bulkhead 14, and a second bulkhead 15 are provided inside the inner body plate 7. A portion behind the partition plate 13, and in front of the first bulkhead 14, is a first (front) expansion chamber C1. A portion spaced away from the first expansion chamber C1 and in back of the second bulkhead 15 is a second (rear) expansion chamber C2, and a portion sandwiched between the first bulkhead 14 and the second bulkhead 15 is a third (intermediate) expansion chamber C3. The numbers of the expansion chambers follow the order in which the exhaust gas passes through the muffler in a regular configuration 1A (described later). The perforated metal partition plate 13 is a sheet metal partition plate punched with a multiplicity of small holes allowing gas to pass freely. The partition plate 13 makes the speed of the exhaust gas uniform, and substantially prevents gas from building up within the first expansion chamber C1.

On the inside of the main body 2, a first communicating pipe 16 passing through the first bulkhead 14 and the second bulkhead 15 is fixed to these bulkheads. A second communicating pipe 17 passing through the second bulkhead 15 is fixed to the second bulkhead 15. It is also possible to provide two first communicating pipes 16 with the same positional relationship with respect to a central line of the body.

Regular Configuration of Muffler System

Figure 2:
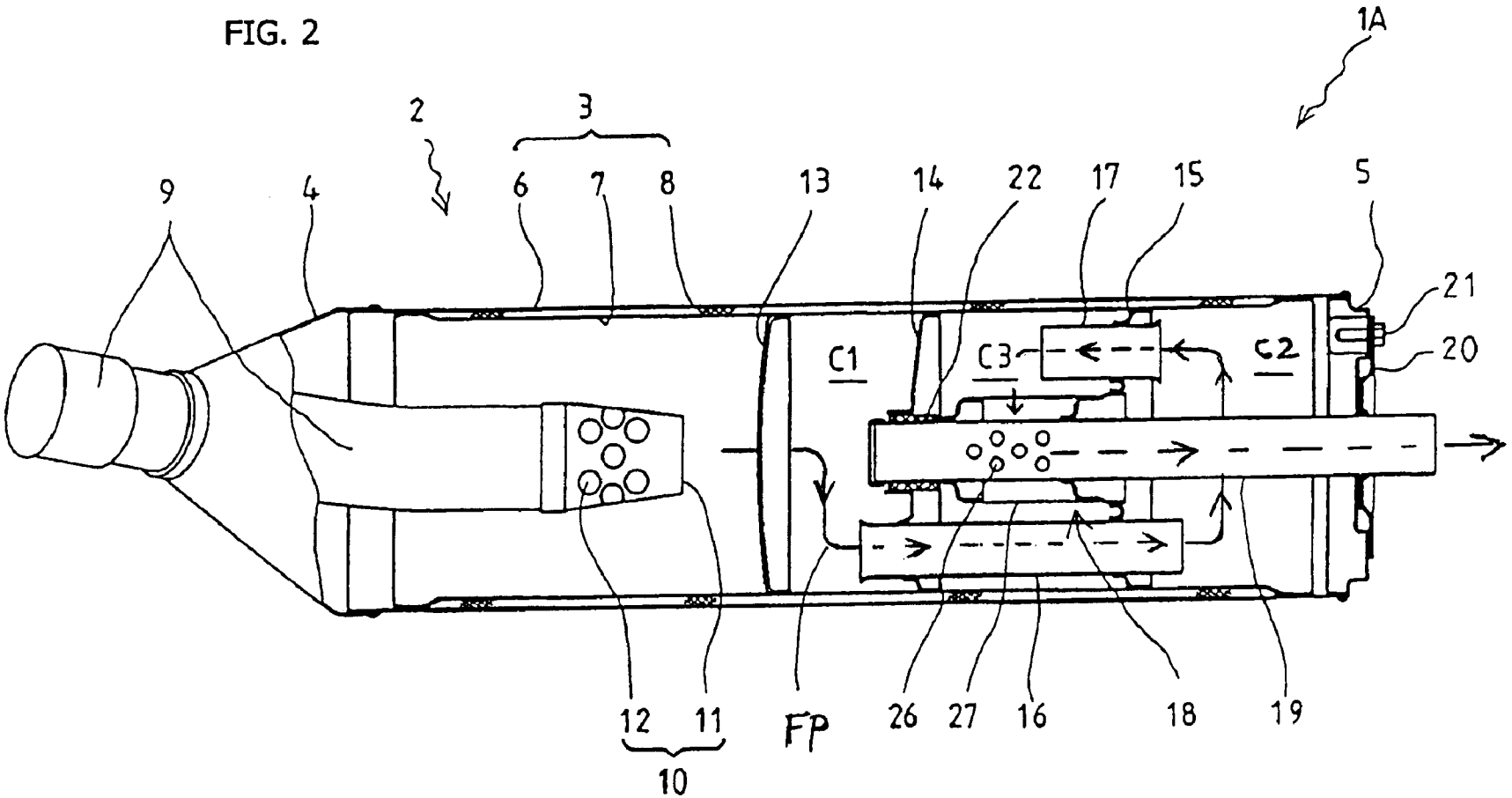
FIG. 2 is a longitudinal cross-sectional view of the exhaust muffler 1 according to the first embodiment hereof, with a regular spark arrester installed therein to form a regular configuration 1A of the muffler system for public road travel.

FIG. 2 is a longitudinal cross-sectional view of the exhaust muffler 1 according to the first embodiment of the present invention, in the regular configuration 1A thereof for public road travel. In this regular configuration 1A, as shown in FIG. 2, the regular spark arrester 18 for public road travel is installed on the main body 2. In the installed configuration thereof, the regular spark arrester 18 passes through the first bulkhead 14, second bulkhead 15, and the rear plate 5.

In the regular configuration of the exhaust system, as depicted in FIG. 2, the bulkheads 14, 15, the communicating pipes 16, 17, and the regular spark arrester 18 cooperate to define an exhaust flow path FP through the main body. The flow path FP is illustrated by a number of arrows in FIG. 2, and passes through the second bulkhead 15 three times before exiting from the tail pipe 19, as will be further detailed herein.

The regular spark arrester 18 for public road travel is installed by attaching a flange 20 to the rear plate 5, using a bolt 21. The flange 20 is welded to the rear part of the tail pipe 19 of the spark arrester. A cylindrical gasket 22 is installed between the tail pipe 19 and the first bulkhead 14, to prevent gas from flowing through the area of connection therebetween.

Figure 3A:
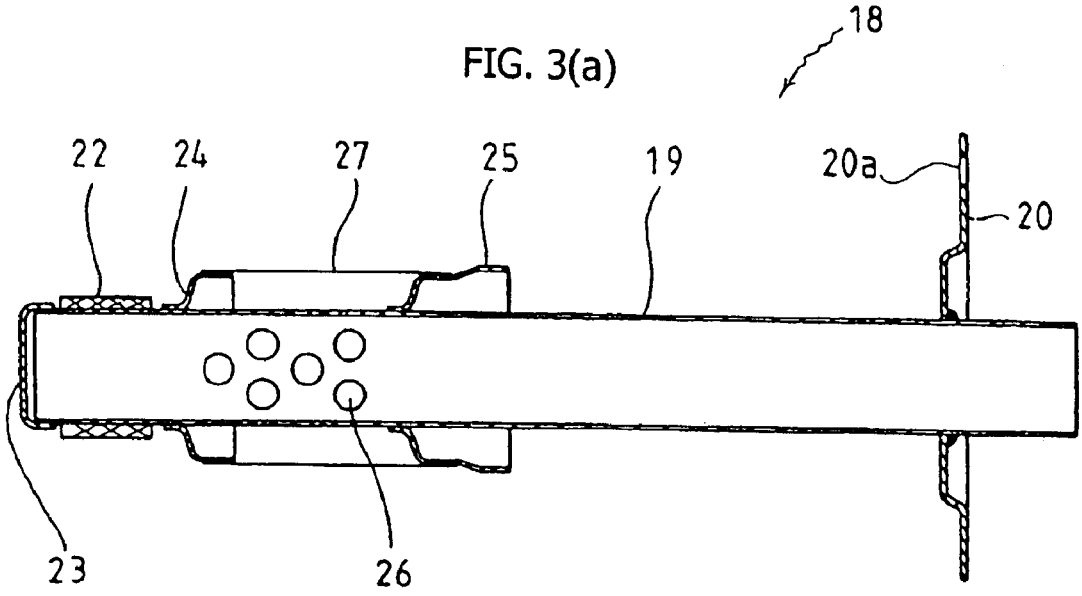
FIG. 3(*a*) is a longitudinal cross-sectional view of the regular spark arrester 18 for use in the exhaust muffler system of the first embodiment during public road travel.
Figure 3B:
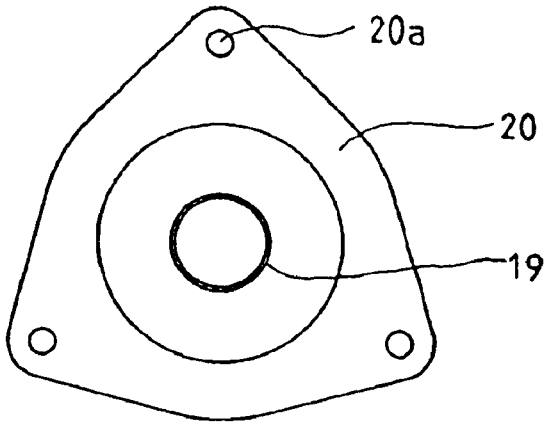

FIG. 3(*a*) is a longitudinal cross-sectional view of the regular spark arrester 18 for use in the regular configuration 1A for the exhaust muffler system. FIG. 3(*b*) is a rear plan view of the regular spark arrester.

The regular spark arrester 18 includes a tail pipe 19 with holes 26 formed through a portion thereof. Other components of the regular spark arrester 18 are welded to the tail pipe 19, including, in order from the front end, a tail pipe front cover 23, a first support ring 24, a second support ring 25, and the flange 20.

The cylindrical gasket 22 is installed at the outer periphery of the tail pipe 19, between the tail pipe front cover 23 and the first support ring 24. A multiplicity of gas-introducing small holes 26 are provided at a portion of the side surface of the tail pipe 19 sandwiched between the first support ring 24 and the second support ring 25.

Further, stainless steel wire mesh 27 surrounds the tail pipe 19 between the first and second support rings 24, 25, and is spot-welded to the outer periphery of the first support ring 24 and the second support ring 25. The wire mesh 27 is provided for filtering sparks and soot out of the exhaust stream, and preventing them from flowing out of the tail pipe 19. A fitting bolt through-hole 20*a* is provided at the flange 20.

With reference to FIG. 2, in the regular configuration 1A of the exhaust muffler system, exhaust gas from the internal combustion engine (not shown) gushing into the main body 2 of the exhaust muffler 1, via the introduction pipe 9, is exhausted to the open air by the following route. After exiting the introduction pipe 9, the exhaust gas flows through the perforated partition plate 13, and then passes through the first expansion chamber C1, first communicating pipe 16, second expansion chamber C2, reverses direction and flows through the second communicating pipe 17, third expansion chamber C3, stainless steel wire mesh 27, gas-introducing small holes 26 and outwardly through the tail pipe 19.

The exhaust gas alternately passes through large volume expansion chambers and long communicating pipes, so that gas pressure is reduced by the extent of repeated expansion and compression, and noise is muffled. The exhaust gas is then filtered by the stainless steel wire mesh 27, before being exhausted from the rear end of the tail pipe 19.

In the regular configuration 1A of this exhaust muffler system for public road travel, the gas flow has a so-called "three-pass" structure, where the gas flow passes through the second bulkhead 15 three times via the first communicating pipe 16, second communicating pipe 17, and the tail pipe 19. This structure improves sound-abating effects by elongating the gas flow path.

Racing Configuration

Figure 4:
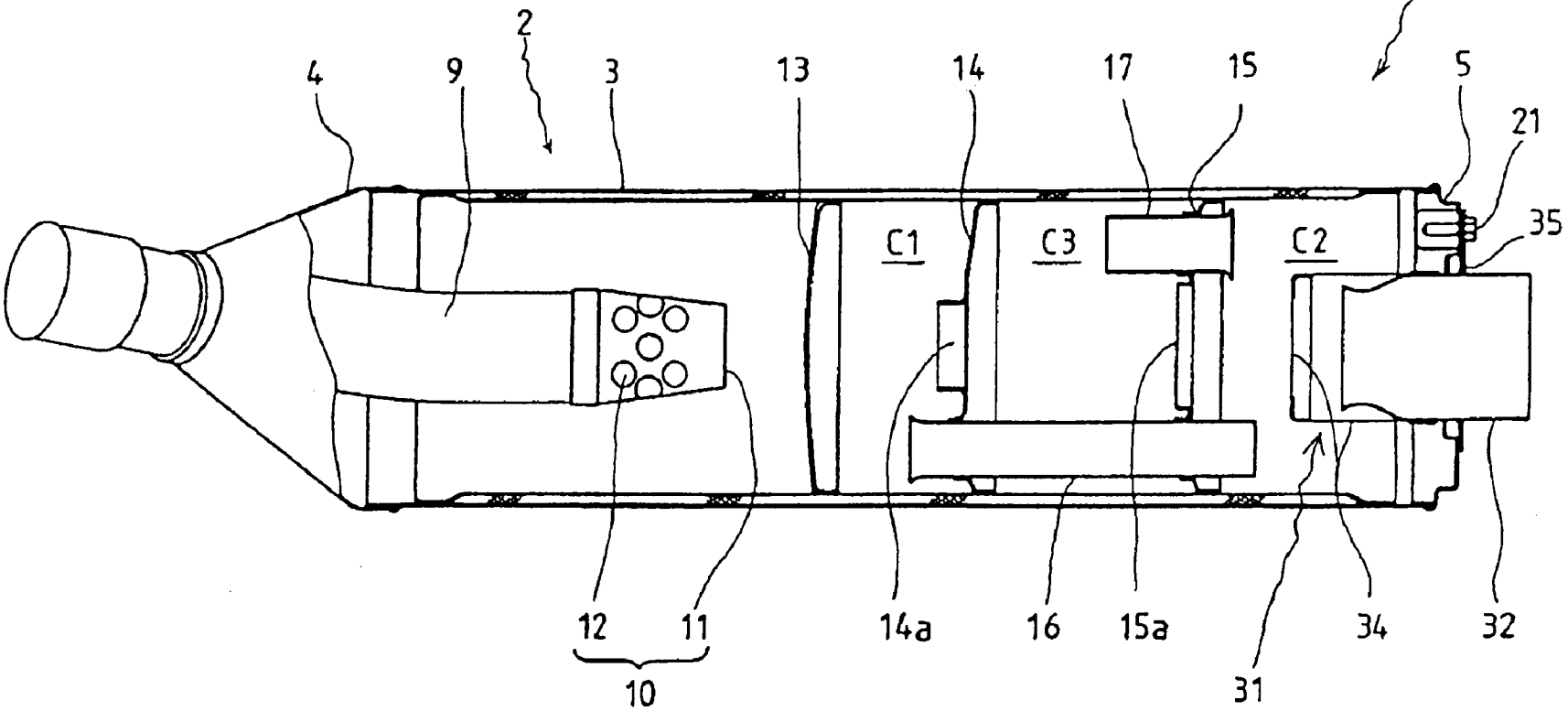
FIG. 4 is a longitudinal cross-sectional view of the exhaust muffler 1 according to the first embodiment hereof, with a racing spark arrester 31 installed therein for a high-performance configuration 1B thereof.

FIG. 4 is a longitudinal cross-sectional view of the exhaust muffler 1 in the racing configuration 1B thereof, according to the first embodiment of the system.

It is possible to improve output of the internal combustion engine, during use of the exhaust muffler system in racing, simply by detaching the regular spark arrester 18. However, when there is no spark arrester, sparks and soot are simply discharged into the open air, and this is disfavored from an environmental point of view.

In the racing configuration 1B of the exhaust muffler system of this embodiment, the regular spark arrester 18 is disconnected and removed from the main body 2, and the racing spark arrester 31 is installed in its place. The dimensions of the racing spark arrester 31 are short in the axial direction. Therefore, in the racing configuration 18, a central through-hole 14*a* for the first bulkhead 14 and a central through-hole 15*a* for the second bulkhead 15 are opened up.

Figure 5A:
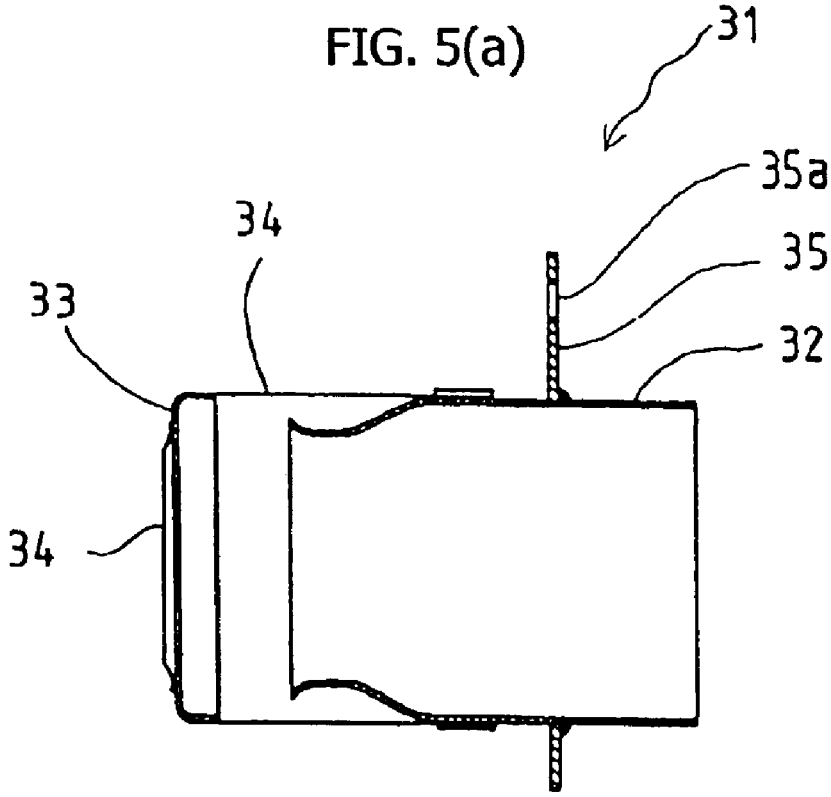
FIG. 5(*a*) is a longitudinal cross-sectional view of a racing spark arrester 31 which is used in both the first embodiment and the second embodiment.
Figure 5B:
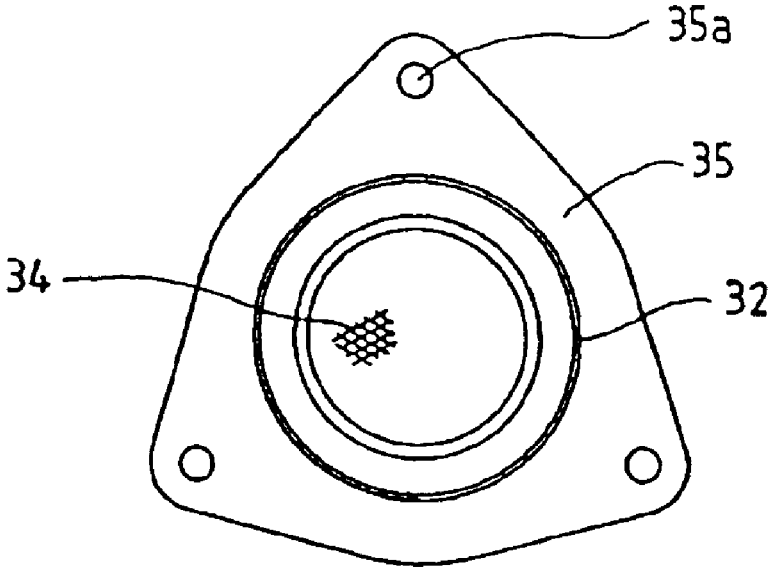

FIG. 5(*a*) is a longitudinal cross-sectional view of a racing spark arrester 31 which is used in both the first embodiment and the second embodiment. FIG. 5(*b*) is a rear plan view of the racing spark arrester 31.

The racing spark arrester 31 includes a tail pipe 32 that is short in the axial direction but has a large diameter, an annular collar member 33, stainless steel mesh 34 stretched at the front surface and side surface of the annular collar member, and a flange 35 welded to the tail pipe 32. The other end of the stainless steel mesh 34, stretched at the side surface of the annular collar member 33, is spot-welded to the tail pipe 32.

As shown in FIG. 4, the racing spark arrester 31 is installed by fixing the flange 35 of the racing spark arrester 31 to the rear plate 5, using a bolt 21 inserted through a fitting bolt insertion hole 35*a*.

In the racing configuration 1B of the exhaust muffler system according to the first embodiment, shown in FIG. 4, exhaust gas from the internal combustion engine, (not shown) gushing into the main body 2 of the exhaust muffler 1 via the introduction pipe 9, is exhausted to the open air by passing linearly through the muffler 1 from front to back.

In detail, the exhaust gas passes through the perforated partition plate 13 into the first expansion chamber C1, passes through the first bulkhead 14 via the central through-hole 14*a*, moves through the centrally located third expansion chamber C3, passes through the second bulkhead 15 via the central through-hole 15*a*, enters the second expansion chamber C2, and passes through the stainless steel mesh 34, and exits from the tail pipe 32.

The central through-holes 14*a*, 15*a* have large diameters and permit the gas to advance in a straight line and therefore present little resistance to the gas flowing out. Further, the tail pipe 32 is also short with a large diameter and therefore also presents little resistance to the gas flowing out. For these reasons, it will be understood that back pressure exerted by the muffler 1 in the racing configuration 1B is less than the back pressure in the regular configuration 1A, and accordingly, the power output of the internal combustion engine is improved by the racing configuration 1B of the exhaust muffler system, equipped with the racing spark arrester 31, and a condition appropriate for racing is attained.

Sealing Considerations

When the exhaust muffler system of the first embodiment is assembled for the regular configuration 1A (FIG. 2), of the first to third expansion chambers, the first expansion chamber C1, at maximum pressure, and the third expansion chamber C3 at minimum pressure are located next to each other. Sound-abating effects decrease sharply if gas leaks between the chambers.

It is therefore necessary to provide a gas leakage prevention seal between the first bulkhead 14 and the regular spark arrester 18. The tail pipe 19 of the regular spark arrester 18 extends when the internal combustion engine is running and retracts when the internal combustion engine is halted, due to normal expansion and contraction of the materials. The seal therefore has to maintain its function, even in the case of the extension and retraction movement of the tail pipe 19 relative to the bulkhead 14.

Figure 6:
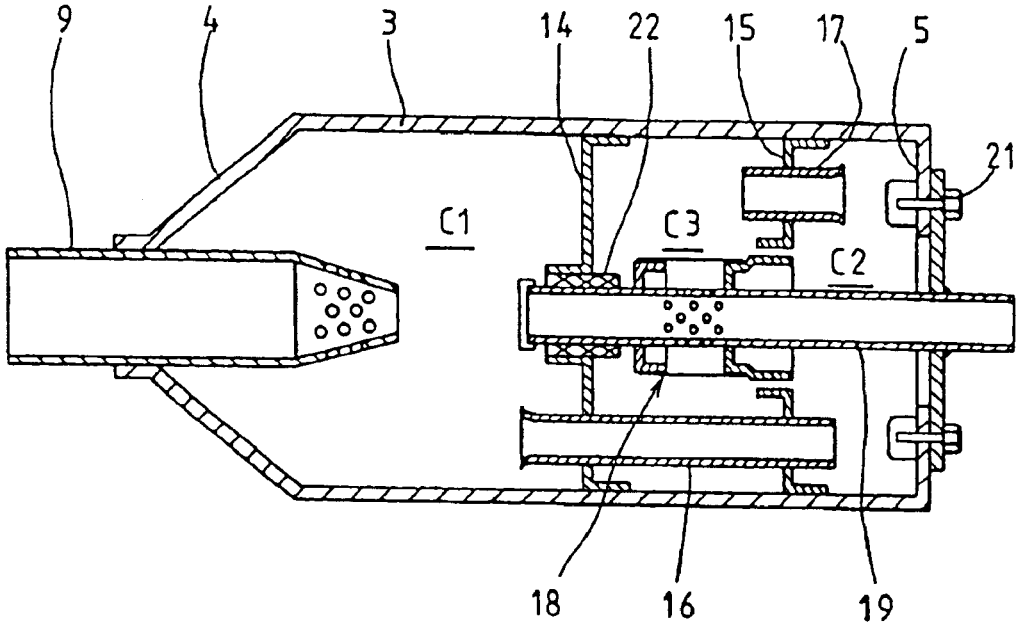
FIG. 6 is a longitudinal cross-sectional view of an exhaust muffler for illustrating a first example of a proposed seal structure that can be applied between the first expansion chamber and the third expansion chamber in the regular configuration 1A thereof.
Figure 7:
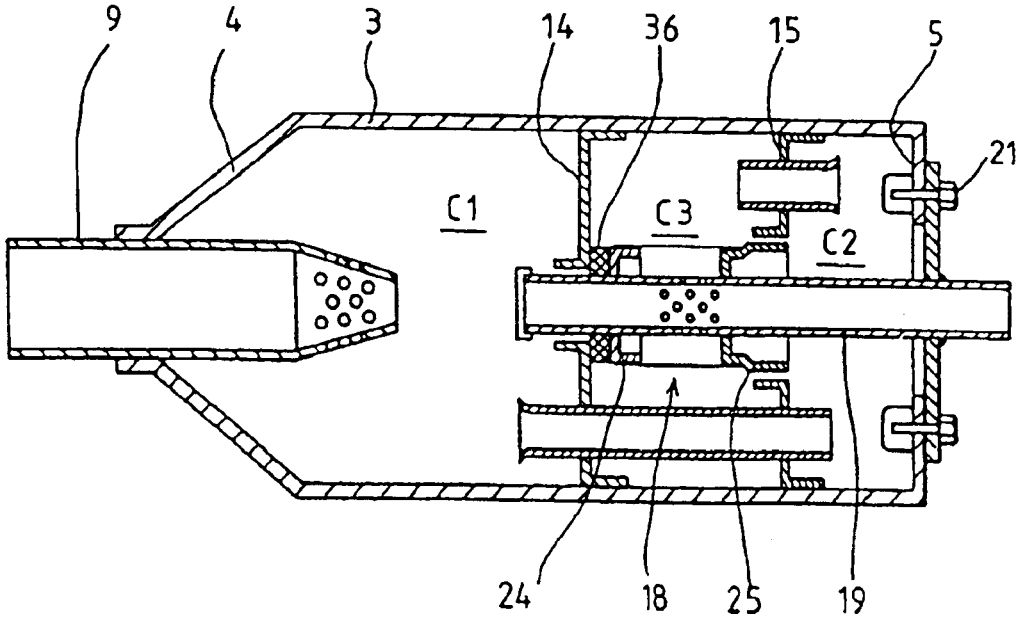
FIG. 7 is a longitudinal cross-sectional view of an exhaust muffler for illustrating a second example of a proposed seal structure that can be applied between the first expansion chamber and the third expansion chamber in the regular configuration 1A thereof.
Figure 8:
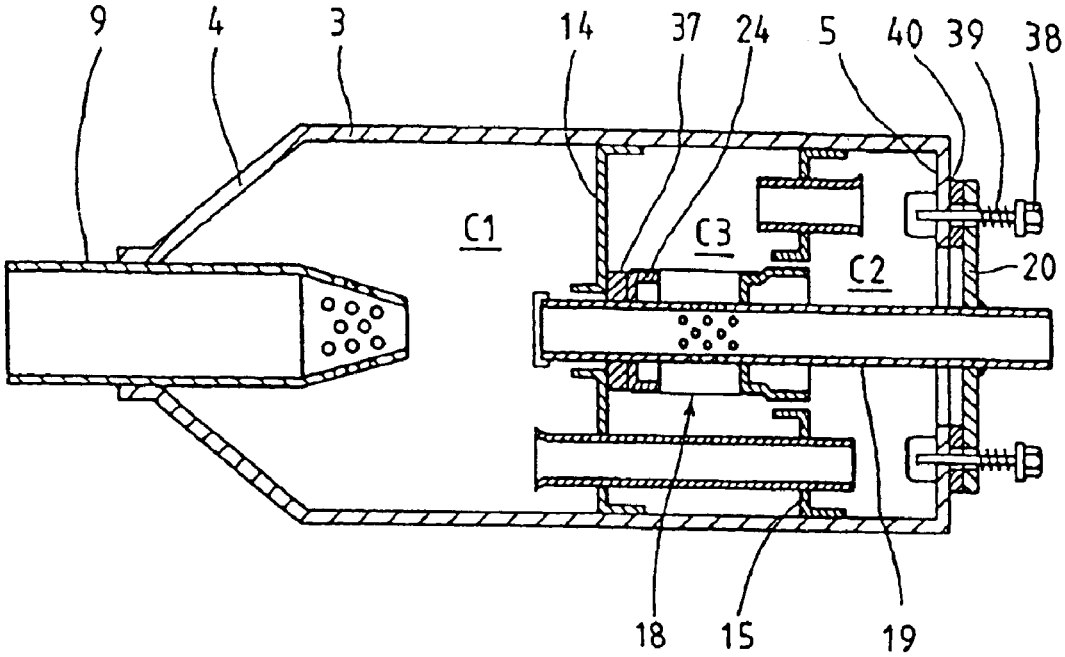
FIG. 8 is a longitudinal cross-sectional view of an exhaust muffler for illustrating a third example of a proposed seal structure that can be applied between the first expansion chamber and the third expansion chamber in the regular configuration 1A thereof.

FIG. 6 to FIG. 8 are longitudinal cross-sectional views of the muffler 1, for illustrating various proposed seal structures that can be applied between the first expansion chamber C1 and the third expansion chamber C3 in the regular configuration 1A of the exhaust muffler system of the first embodiment. Portions in FIGS. 6–8 corresponding to portions shown in FIG. 2 are given the same numerals. The drawings are slightly simplified. The perforated metal partition plate 13 is not the object of discussion and is therefore omitted from these drawings.

FIG. 6 is an example where the cylindrical gasket 22, of the type shown in FIG. 2, is installed between the first bulkhead 14 and the tail pipe 19 of the regular spark arrester 18. This seals in the diameter direction. A stainless steel wool gasket, a glass wool gasket, a steel gasket, or a cladding material of these can be used as the gasket 22. Mutual sliding takes place with a member making contact at the outer periphery or the inner periphery of the gasket 22, in order to permit extension and retraction of the tail pipe 19, the rear end of which is fixed in place.

FIG. 7 is an example where a resilient ring-shaped gasket 36 is installed between the first bulkhead 14 and a first support ring 24 (FIG. 3) of the regular spark arrester 18. This seals in an axial direction. This gasket 36 is made of a fibrous aluminum material. This may be SUS material or SK material, etc. These are extendable and retractable gasket materials. Further, the inner periphery of the ring-shaped resilient gasket 36 and the tail pipe 19 are capable of sliding over each other. It is therefore possible to permit extension and retraction of the tail pipe 19, the rear end of which is fixed in place.

FIG. 8 is an example where a ring-shaped metal member 37 fitted to a tail pipe 19 of the regular spark arrester 18 is thrust in an axial direction from the rear end side of the tail pipe 19 towards the first bulkhead 14. The tail pipe 19 is urged forward by a coil spring 39 fitted between a bolt screwed into the rear plate 5 and the flange 20 welded to the rear end of the tail pipe 19. This causes the tail pipe 19 to push the ring-shaped metal member 37 in the direction of the first bulkhead 14.

In order to ensure reliable contact with the first bulkhead 14 of the ring-shaped metal member 37, it is necessary to provide a gap between the rear plate 5 and the flange 20 even under initial conditions. In order to prevent gas leaking from between the rear plate 5 and the flange 20, a gasket 40 having resilience is fitted to this part. When the tail pipe 19 expands due to heating, the tail pipe 19 extends to the rear while pushing in the coil spring so as to permit extension and retraction of the tail pipe 19.

With regards to increasing the gap between the rear plate 5 and the flange 20, gas leakage is prevented by using a resilient gasket 40. In the above example, a separate ring-shaped metal member 37 is provided to the front of the first support ring 24, but it is also possible for the first support ring 24 to make contact with the first bulkhead 14.

Second Embodiment

Next, a description is given of a configuration for an exhaust muffler system 41 according to a second embodiment of the present invention. The exhaust muffler system 41 of the second embodiment includes a set of three members, an exhaust muffler body 42, and two interchangeable spark arresters 53, 31 that can be selectively and interchangeably attached to or detached from the main body 42.

The spark arresters include a regular spark arrester 53 and a racing spark arrester 31. The two types of spark arrester can be changed according to the purpose of the vehicle use.

A state in which the regular spark arrester 53 is installed at the exhaust muffler body 42 is referred to as a regular configuration 41A of the exhaust muffler 41 of the second embodiment. A state where the racing spark arrester 31 is installed at the exhaust muffler body 42 is referred to as a racing configuration 41B of the exhaust muffler 41 of the second embodiment. The racing spark arrester 31 is the same as that (of FIG. 5) used in the first embodiment. This exhaust muffler 41 is also adapted to be connected to an exhaust pipe of an internal combustion engine of a motorcycle or four-wheeled vehicle as shown in FIG. 13 and FIG. 14.

Figure 9:
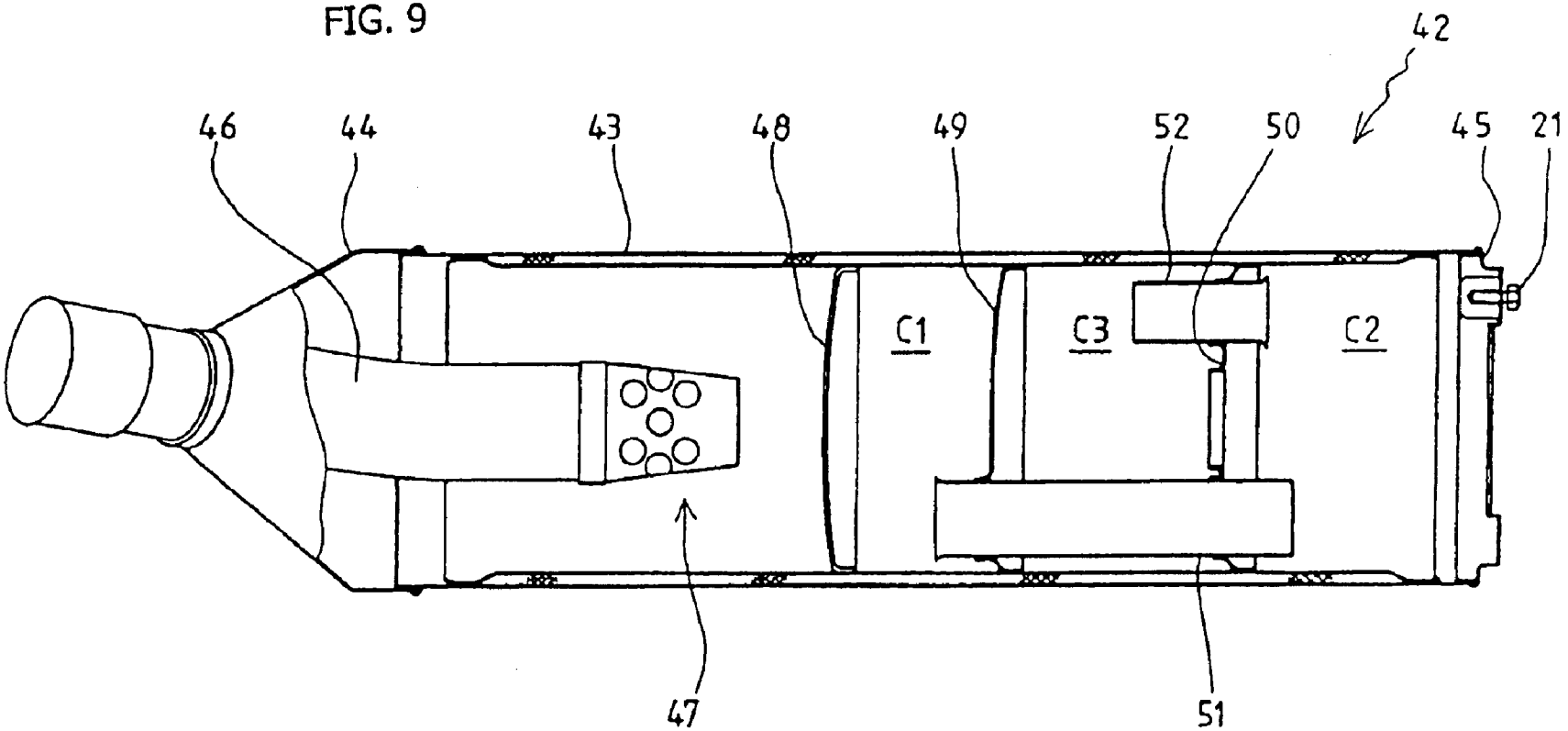
FIG. 9 is a longitudinal cross-sectional view of the main body 42 of the exhaust muffler 41 of a second embodiment of the present invention.

FIG. 9 is a vertical cross-section of a main body 42 of the exhaust muffler 41. In FIG. 9, the outward appearance of the main body 42 of the exhaust muffler 41 includes a cylindrical central body part 43, a conical front cover 44, and a rear plate 45 having a large opening at a central part thereof.

An introduction pipe 46, for connecting to the exhaust pipe of the internal combustion engine, passes through the top part of the front cover 44 and is integrally connected to an exhaust gas nozzle 47, which opens out within the main body 42. This configuration is the same as for the first embodiment.

In order from the front, a perforated metal partition plate 48, a first bulkhead 49, and a second bulkhead 50 are provided within the main body 42 at the inside of an inner body plate. A portion behind the partition plate 48 and in front of the first bulkhead 49 is a first (front) expansion chamber C1. A portion in back of the second bulkhead 50 is a second (rear) expansion chamber C2, and a portion sandwiched between the first bulkhead 49 and the second bulkhead 50 is a third (intermediate) expansion chamber C3.

The numbers of the expansion chambers follow the order with which the exhaust gas passes through in a regular configuration 41A of the exhaust system 41 (described later). A perforated metal partition plate 48 is a sheet metal partition plate punched with a multiplicity of small holes. The speed of the exhausted gas is therefore made uniform and gas is prevented from building up in the first expansion chamber C1. A first communicating pipe 51 passing through the first bulkhead 49 and the second bulkhead 50 is fixed to these bulkheads. A second communicating pipe 52 passing through the second bulkhead 50 is fixed to the second bulkhead 50.

The point where the exhaust muffler body 42 differs from the exhaust muffler body 2 of the first embodiment is that there is no central through-hole formed in the first bulkhead 42. The first communicating pipe 51 is made slightly thicker to take performance into consideration when converting to a race configuration 42B (described later). It is also possible to provide two first communicating pipes 51 of slightly smaller diameters with the same positional relationship with respect to a central line of the body.

Figure 10:
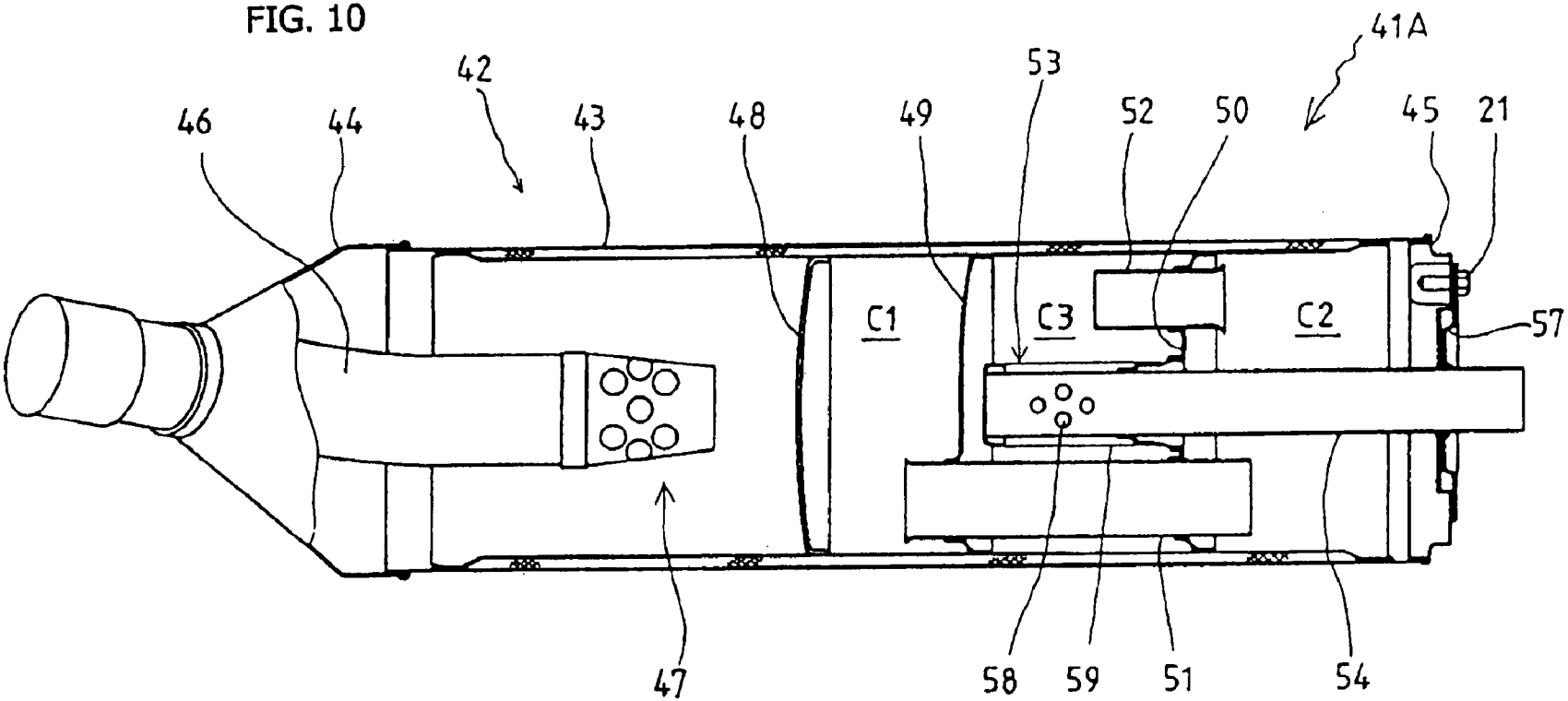
FIG. 10 is a longitudinal cross-sectional view of the exhaust muffler 41 of the second embodiment, with a regular spark arrester installed therein for a regular configuration 41A thereof.

FIG. 10 is a longitudinal cross-sectional view of regular configuration 41A of the exhaust muffler 41 of the second embodiment of the present invention. In this configuration 41A, the regular spark arrester 53 is installed so as to pass through the second bulkhead 50, and the rear plate 45.

The regular spark arrester 53 is installed by fixing a flange 57 welded to the rear end part of the tail pipe 54 of the central part to the rear plate 45 using a bolt 21. The overall length of the regular spark arrester 53 is made short to provide compatibility with the fact that the first bulkhead 49 has no central through-hole.

Figure 11A:
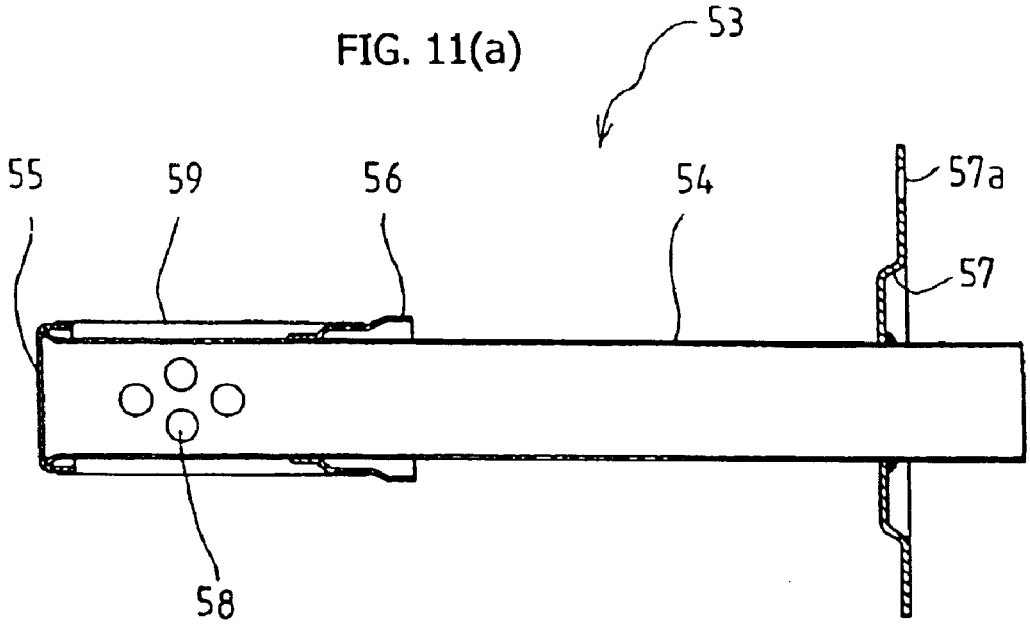
FIG. 11(*a*) is a longitudinal cross-sectional view of the regular spark arrester 53 for use in the exhaust muffler 41 of the second embodiment during public road travel.
Figure 11B:
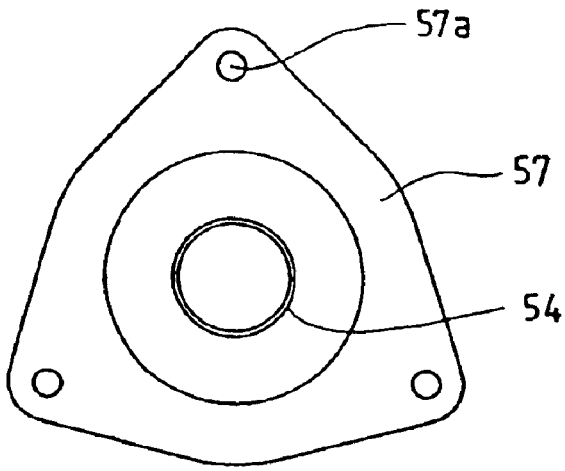

FIG. 11(*a*) is a longitudinal cross-sectional view of the regular spark arrester 53 for use in the exhaust muffler 41 of the second embodiment during public road travel.

FIG. 11(*b*) is a rear plan view of the regular spark arrester 53 of FIG. 11(*a*).

Referring now to FIG. 11(*a*), in order from the front, a tail pipe front cover 55, a support ring 56, and a flange 57 are welded to a center tail pipe 54. A multiplicity of gas-introducing small holes 58 are made in the side surface of the front end part of the tail pipe 46. A stainless steel mesh 59 is made to span the side surface of the tail pipe front cover 55 and the support ring 56 and is spot-welded. The regular spark arrester 53 is fitted to the rear plate 45 using a bolt 21 inserted through a fitting bolt through-hole 57*a* of a flange 57 that is welded to the tail pipe 54.

In the regular configuration 41A of the exhaust muffler 41 shown in FIG. 10, exhaust gas exhausted from the internal combustion engine (not shown) gushing into the main body 42 of the exhaust muffler 41 via the introduction pipe 46 is exhausted by passing through the first expansion chamber C1, first communicating pipe 51, second expansion chamber C2, second communicating pipe 52, third expansion chamber C3, stainless steel wire mesh 59, gas-introducing small holes 58 and tail pipe 54.

The gas flow for this exhaust muffler 41 is also a so-called three-pass structure where the gas flow passes through the second bulkhead 50 three times. The exhaust gas alternately passes through large volume expansion chambers and long communicating pipes so that gas pressure is reduced by the extent of repeated expansion and retraction, noise is muffled, and the exhaust gas is then purified by the stainless steel wire mesh 59 before being exhausted to the open air from the rear end of the tail pipe 54.

There is no central through-hole at the first bulkhead at the exhaust muffler 41 of this embodiment. The gas leakage seal structure (FIG. 6 to FIG. 8) provided in order to prevent gas from leaking between the first expansion chamber C1 and the third expansion chamber C3 in the regular configuration 1A of the exhaust muffler system of the first embodiment can therefore be omitted and the structure is simplified accordingly.

Figure 12:
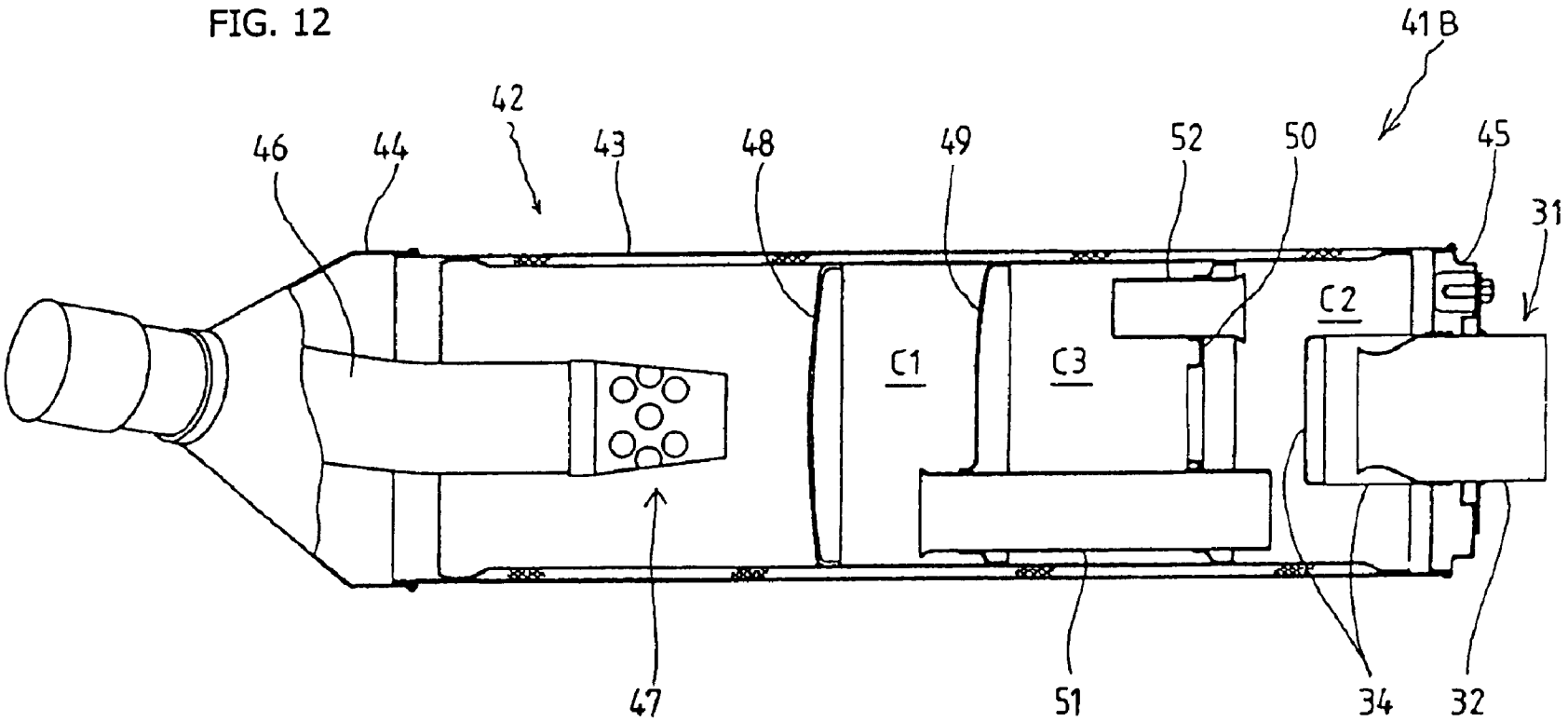
FIG. 12 is a longitudinal cross-sectional view of the exhaust muffler 41 of the second embodiment, with the racing spark arrester 31 installed therein for a high-performance configuration 41B thereof.

FIG. 12 is a longitudinal cross-sectional view of racing configuration 41B of the exhaust muffler 41 of the second embodiment. It is possible to improve output of the internal combustion engine during use of the exhaust muffler 41 in racing simply by detaching the regular spark arrester 53.

However, when there is no spark arrester, sparks and soot are simply discharged into the open air and this is disfavored from an environmental point of view. Because of this, when the regular spark arrester 53 is removed, and the racing spark arrester 31 short in overall length shown in FIG. 5 is installed. The racing spark arrester 31 is the same as that used in the first embodiment.

In the racing configuration 41B (FIG. 12) of the exhaust muffler 41 of the second embodiment, exhaust gas exhausted from the internal combustion engine (not shown) gushing into the main body 42 of the exhaust muffler 41 via the introduction pipe 46 is exhausted to the open air by passing through the first expansion chamber C1, first communicating pipe 51, second expansion chamber C2, stainless steel mesh 34 and tail pipe 32.

In the race configuration 41B of this embodiment, exhaust gas passes through the first communicating pipe 51 so as to be exhausted to the open air without necessarily passing through the third expansion chamber C3. Namely, compared to the regular configuration 41A (FIG. 10), the path by which gas flows out is made shorter. There is therefore little resistance to the gas flowing out, the output of the internal combustion engine is improved, and a state appropriate for racing is attained.

With the race configuration 41B of the exhaust muffler 41 of the second embodiment, the exhaust gas cannot go through the center of the first bulkhead in a straight line, and makes a detour so as to flow via the first communicating pipe 51. The increase in output of the internal combustion engine is therefore insufficient. Because of this, the first communicating pipe 51 of this embodiment is of a diameter that is made large compared to the first communicating pipe 16 of the exhaust muffler 1 of the first embodiment in order to reduce resistance to the gas flowing out. Instead of this, it would also be possible to provide two first communicating pipes 51 of smaller diameters.

As described in detail above, in each of the above embodiments, a spark arrester equipped with a tail pipe is detachably provided at a rear part of an exhaust muffler body equipped with a plurality of expansion chambers defined by a plurality of bulkheads. It is therefore possible to provide quick-change compatibility with use either on public roads or in racing, without changing the main body, simply by removing a regular spark arrester and replacing this spark arrester with a racing spark arrester.

A three-pass structure is adopted for use when traveling on public roads, and the silencing of the exhaust muffler is therefore improved. When the spark arrester is then removed or is replaced with a racing spark arrester, the output of the internal combustion engine is improved. It is therefore possible to divide use of this exhaust muffler between traveling on public roads and racing use, without removing the main body of the exhaust muffler.

Further, in the regular configuration 1A of the exhaust muffler system of the first embodiment, leakage of gas or sound into a neighboring expansion chamber does not occur due to the seal structure shown in FIG. 6 to FIG. 8 and silencing is therefore improved. Further, the tail pipe has a slide structure that permits extension and retraction thereof. Thermal expansion is therefore accommodated, there is little fatigue even with repeated expansion and retraction, and durability is improved.

Further, it is therefore possible to provide a minimum pressure third expansion chamber next to a maximum pressure first expansion chamber within the main body 2 of the exhaust muffler 1, a three-pass structure can be realized, and silencing on public roads can be improved. With the exhaust muffler 41 of the second embodiment, a central through-hole for passing the tail pipe through the first bulkhead is omitted. Sound muffling occurring in the regular configuration 41A is therefore improved, the seal structure between the first expansion chamber and the third expansion chamber is not necessary, and the structure is simplified.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having thus, described the invention, what is claimed is:

1. An exhaust muffler for use with an internal combustion engine, said exhaust muffler comprising:

a hollow main body having a plurality of bulkheads therein, said bulkheads dividing the interior of said main body into a plurality of expansion chambers;

said main body being connectable to an exhaust pipe of an internal combustion engine;

a plurality of communicating pipes fixed in said main body so as to connect the expansion chambers; and a spark arrester which is removably attachable to said main body and which comprises a tail pipe;

wherein said muffler is configured such that when the spark arrester is attached to said main body, exhaust flow is made to pass through at least one bulkhead three times by the spark arrester installed so as to connect the expansion chambers and by the plurality of communicating pipes fixed so as to connect the expansion chambers, and when the spark arrester is removed, exhaust flow may pass through the communicating pipes and may bypass one of the plurality of expansion chambers so as to be released to the outside.

2. An exhaust muffler for use with an internal combustion engine, said exhaust muffler comprising:

a hollow main body having a plurality of bulkheads therein, said bulkheads dividing the interior of said main body into a plurality of expansion chambers;

said main body being connectable to an exhaust pipe of an internal combustion engine;

a plurality of communicating pipes fixed in said main body so as to connect the expansion chambers; and a spark arrester which is removably attachable to said main body and which comprises a tail pipe, wherein said muffler is configured such that when the spark arrester is installed, exhaust flow is made to pass through at least one bulkhead three times by the spark arrester installed so as to connect the expansion chambers and by the plurality of communicating pipes fixed so as to connect the expansion chambers, and when the spark arrester is removed, exhaust flow may pass straight through a through-hole opening in each of the bulkheads and outwardly from said main body so as to be released outside of said exhaust muffler.

3. The exhaust muffler for an internal combustion engine of claim 2, wherein a seal is provided between one of said bulkheads and the spark arrester, and wherein the seal comprises a sliding part or elastic part permitting extension and retraction of the tail pipe in the lengthwise direction thereof relative to said bulkhead.

4. An exhaust muffler system for use with an internal combustion engine, said exhaust muffler system comprising:

a hollow main body defining an enclosed space therein, said main body having first and second bulkheads therein which operate to separate said enclosed space into a plurality of expansion chambers, said second bulkhead having a hole formed therethrough for receiving a spark arrester;

said main body being connectable to an exhaust pipe of an internal combustion engine;

a plurality of communicating pipes fixed in said main body so as to connect the expansion chambers;

a regular spark arrester which is selectively removably attachable to said main body to define a regular configuration of said muffler system for use in public road travel, and which comprises a tail pipe, wherein a portion of said regular spark arrester fits through said hole in said second bulkhead; and a racing spark arrester which is alternately attachable to said main body to define a racing configuration of said muffler system, wherein said hole in said second bulkhead is left open and unobstructed in said racing configuration.

5. The exhaust system of claim 4, wherein said bulkheads, said communicating pipes and said regular spark arrester cooperate to define an exhaust flow path through said main body in the regular configuration of said system, said flow path passing through said second bulkhead three times before exiting from said tail pipe.

6. The exhaust system of claim 4, further comprising a seal for placement between one of said bulkheads and the regular spark arrester, and wherein the seal is configured to permit extension and retraction of the tail pipe in the lengthwise direction thereof relative to said bulkhead.

7. The exhaust system of claim 4, wherein the first bulkhead has a hole formed therethrough to slidably receive a front end of said spark arrester.

8. The exhaust system of claim 7, further comprising a seal for placement between said first bulkhead and the regular spark arrester, wherein the seal is configured to permit extension and retraction of the tail pipe in the lengthwise direction thereof relative to said bulkhead.

9. An exhaust muffler system for use with an internal combustion engine, said exhaust muffler system comprising:

a hollow main body defining an enclosed space therein, said main body having a plurality of bulkheads therein which operate to separate said enclosed space into a plurality of expansion chambers, at least one of said bulkheads having a hole formed therethrough for receiving a spark arrester;

said main body being connectable to an exhaust pipe of an internal combustion engine;

a plurality of communicating pipes fixed in said main body so as to connect the expansion chambers;

a regular spark arrester which is selectively removably attachable to said main body to define a regular configuration of said muffler system for use in public road travel; and a racing spark arrester which is alternately attachable to said main body to define a racing configuration of said muffler system.

10. The exhaust system of claim 9, wherein said bulkheads, said communicating pipes and said regular spark arrester cooperate to define an exhaust flow path through said main body in the regular configuration of said system, said flow path passing through one of said bulkheads three times before exiting from said tail pipe.

11. The exhaust system of claim 9, further comprising a seal for placement between one of said bulkheads and the regular spark arrester, and wherein the seal is configured to permit extension and retraction of the tail pipe in the lengthwise direction thereof relative to said bulkhead.

* * * * *